United States Patent [19]

Brooks

[11] 3,986,516

[45] Oct. 19, 1976

[54] COOL PIPE WITH SELF IGNITION MEANS

[76] Inventor: Leslie P. Brooks, 400 W. Taylor, McAlester, Okla. 74501

[22] Filed: June 20, 1975

[21] Appl. No.: 588,878

Related U.S. Application Data

[63] Continuation-in-part of Ser. No. 530,824, Dec. 9, 1974, abandoned.

[52] U.S. Cl. ..... 131/185

[51] Int. Cl.[2] ..... A24F 27/00

[58] Field of Search ..... 131/173, 174, 185, 186, 131/194, 184 A

[56] References Cited

UNITED STATES PATENTS

| | | | |
|---|---|---|---|
| 1,849,795 | 3/1932 | Fenton | 131/185 UX |
| 3,402,723 | 9/1968 | Hu | 131/185 |
| 3,804,100 | 4/1974 | Fariello | 131/185 X |
| 3,882,876 | 5/1975 | Covington | 131/185 |
| 3,889,690 | 6/1975 | Guarnieri | 131/185 |
| 3,918,464 | 11/1975 | Kolodziej | 131/185 X |

FOREIGN PATENTS OR APPLICATIONS

| | | | |
|---|---|---|---|
| 487,450 | 6/1949 | Canada | 131/185 |

*Primary Examiner*—Robert W. Michell
*Assistant Examiner*—V. Millin
*Attorney, Agent, or Firm*—Richard A. Bachand

[57] ABSTRACT

A pipe including self-contained means for igniting the tobacco has an outer bowl and an inner sub-bowl placed in the outer bowl. The sub-bowl is of smaller size than the outer bowl to define a smoke cavity between the outside wall of the sub-bowl and the inside wall of the outer bowl. The sub-bowl includes a plurality of holes adjacent its top above the tobacco level to enable the smoke generated in the tobacco to be drawn through the holes into the smoke cavity and through the pipe stem, outwardly extending from the outside bowl in a conventional manner. A third container including a heating element energizeable from an external power source is located at the base of the sub-bowl to receive and ignite the tobacco. An air vent tube is provided in one embodiment, extending through the wall of the outer bowl to the smoke cavity to cut the density of the smoke produced, The vent can be closed by the user's finger, as desired. Also, a light is provided in the wall of the outer bowl to indicate the energization of the heating element. The thermal insulation properties of the sub-bowl enable the pipe to be easily handled and to develop a cool smoke.

8 Claims, 3 Drawing Figures

COOL PIPE WITH SELF IGNITION MEANS

CROSS REFERENCES TO RELATED APPLICATIONS

This application is a continuation-in-part of copending application Ser. No. 530,824 filed Dec. 9, 1974 now abandoned.

BACKGROUND OF THE INVENTION

1. Field of the Invention

This invention relates generally to improvements in smokers' pipes, and more particularly, to smokers' pipes of the type which include self-contained tobacco ignition means.

2. Description of the Prior Art

In the tobacco pipe art, many attempts have been made to provide a heating or igniting element within the bowl of the pipe so that matches, lighters, and other tobacco ignition means separate from the pipe are not required. For example, an early embodiment of a pipe with a contained heating element is shown in Fulton, U.S. Pat. No. 1,157,771, which shows an ordinary pipe having a heating element extending through a bottom portion of a tobacco receiving bowl, adapted to be connected to an electrical source.

A more recent development upon the self-contained ignition means within a pipe bowl is shown by Yow-Jiun Hu, U.S. Pat. No. 3,402,723, in which both a heating element and a rechargeable battery are self-contained within the bowl of the pipe. The rechargeable battery is recharged between use by mating contacts presented in a pipe stand, the contacts being connectable to a wall outlet or other source of electrical energy. Another embodiment of a pipe with a self-contained electrical ignition element is shown by Lane, Canada Pat. No. 457,450, which discloses a unique pipe configuration in which the tobacco is removed from the area in which it is burned, after it has been consumed, to avoid some of the problems Lane describes as undesirable when the smoke travels through unburned tobacco.

In the pipes of the above described type in which a self-contained heating element is provided, one problem which is of considerable concern is the large amount of heat which is generated by the igniting element. This problem is particularly acute when the igniting element is located near the base or bottom of the tobacco receiving bowl, such as in the embodiments advanced by Fulton and Yow-Jiun Hu. One reason for the relatively high heat encountered in such pipes is that at the bottom of the bowl, less oxygen exists to take part in the combustion of the tobacco, and that which does exist must be drawn through the unburned tobacco packed above it within the bowl. (This is in contradistinction to the ordinary pipes which are ignited and burned from the top from which the ashes are either removed or packed during the smoking process, and in which the oxygen is in relatively plentiful supply.) Therefore, for combustion and consumption of the tobacco, ordinarily the igniting element must be operated for longer time periods than matches or conventional lighters, and, also, much greater burning temperatures are required.

The high temperatures encountered present several problems to the smoker. First, the pipe itself becomes hot and is difficult to handle for prolonged periods of use. Also, the briar from which the pipe is made tends to become charred or burned, reducing the useful lifetime of the pipe, and, in some instances, imparting an undesirable taste to the tobacco smoker.

Another problem caused by the relatively high temperatures is that the smoke produced is itself of rather high temperature, which can cause heat bite to the smoker's tongue, and which is otherwise undesirable.

SUMMARY OF THE INVENTION

In light of the above, it is an object of the invention to provide a smoker's pipe which has a self-contained ignition means.

It is another object of the invention to provide a smoker's pipe which is relatively cool to handle, and which produces relatively cool tobacco smoke.

These and other objects, features and advantages will become apparent to those skilled in the art from the following detailed description, when read in conjunction with the accompanying drawing and appended claims.

The smoker's pipe, in accordance with the principles of the invention, in its broad aspect, presents a pipe having a first bowl of heat insulating material. A second bowl is contained within the first bowl, and is adapted to receive tobacco therewithin. The top of the second bowl is flared and is in engagement with the top of the first bowl, and the body of the second bowl is of smaller size than the interior of the first bowl, thereby defining a smoke receiving cavity between the first and second bowls. The second bowl has a plurality of holes adjacent the flared top above the tobacco level within the second bowl to pass the smoke generated adjacent the bottom of the second bowl into the smoke receiving cavity. A stem outwardly extends from adjacent a bottom portion of the first bowl having a longitudinal channel herewithin in communication with the smoke receiving cavity to permit smoke within the smoke receiving cavity to be withdrawn therefrom. An electrical heating element for igniting the tobacco is provided in the second bowl, and means attached to the first bowl, extending through the second bowl, for carrying the heating element within the second bowl adjacent a bottom portion thereof is provided, which is connected or attached to a source of electrical potential to energize the element to ignite the tobacco.

BRIEF DESCRIPTION OF THE DRAWING

The invention is illustrated in the accompanying drawing, wherein.

DESCRIPTION OF THE PREFERRED EMBODIMENTS

Figures 1, 2:
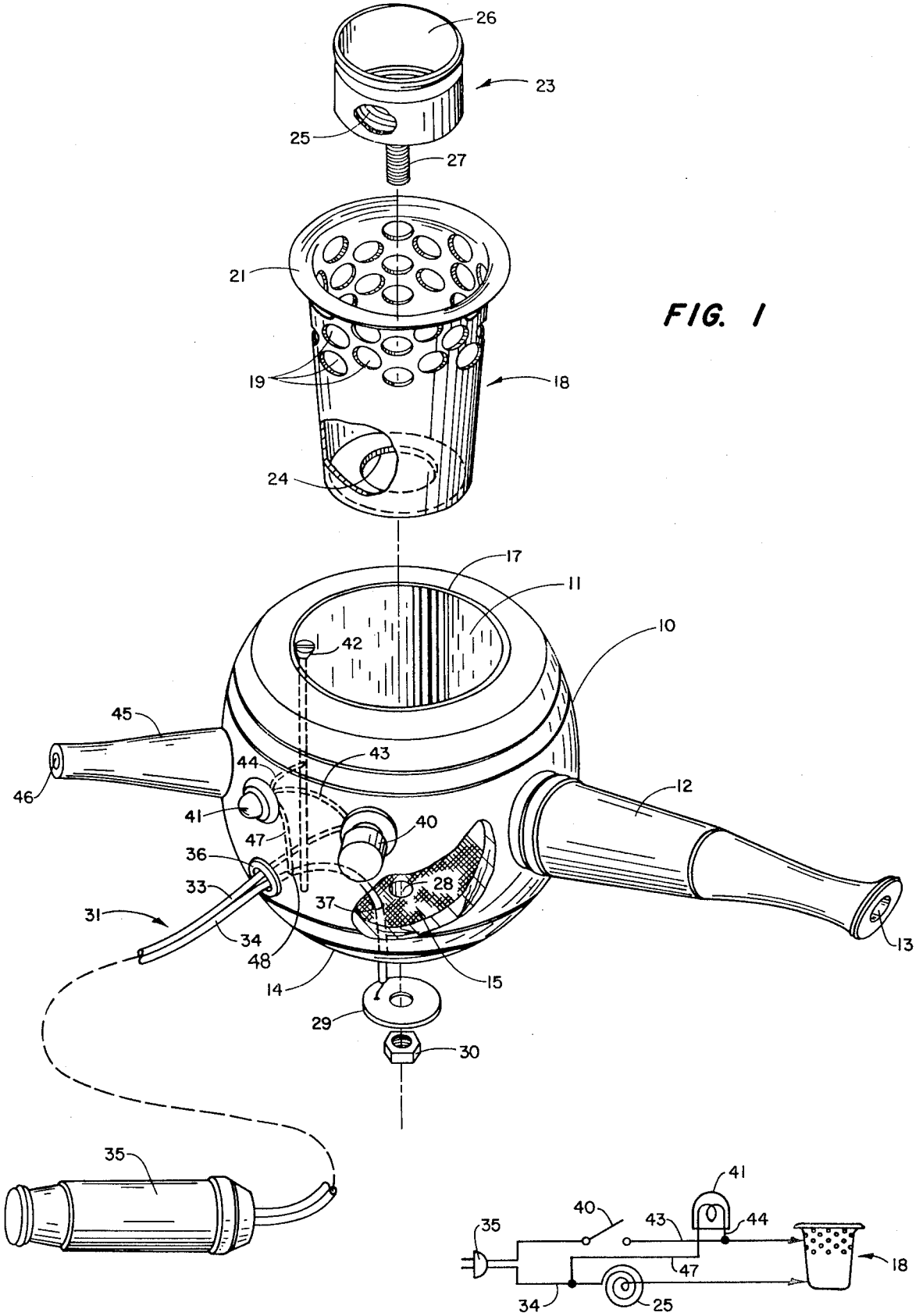
FIG. 1 is an exploded perspective view, partially cut away, of a pipe in accordance with the principles of the invention.
FIG. 2 is a schematic diagram showing the electrical circuit of the pipe of FIG. 1.

A preferred embodiment of the pipe, in accordance with the invention, is shown in an exploded perspective view in FIG. 1, and in a cut-away elevation view in FIG.

3. The pipe includes a bowl 10 having an interior cavity 11 therewithin in a fashion similar to conventional pipe bowls. The bowl 10 can be of any convenient pipe material, such as briar, meerschaum, or other conventional pipe material. A stem 12 extends outwardly from a wall of the pipe bowl 10, preferably adjacent a bottom or middle portion thereof, for ease of handling. The stem 12 has an interior cavity or channel 13 which communicates with the interior 11 of the bowl 10 for withdrawing the smoke therefrom, in a conventional manner.

Figure 3:
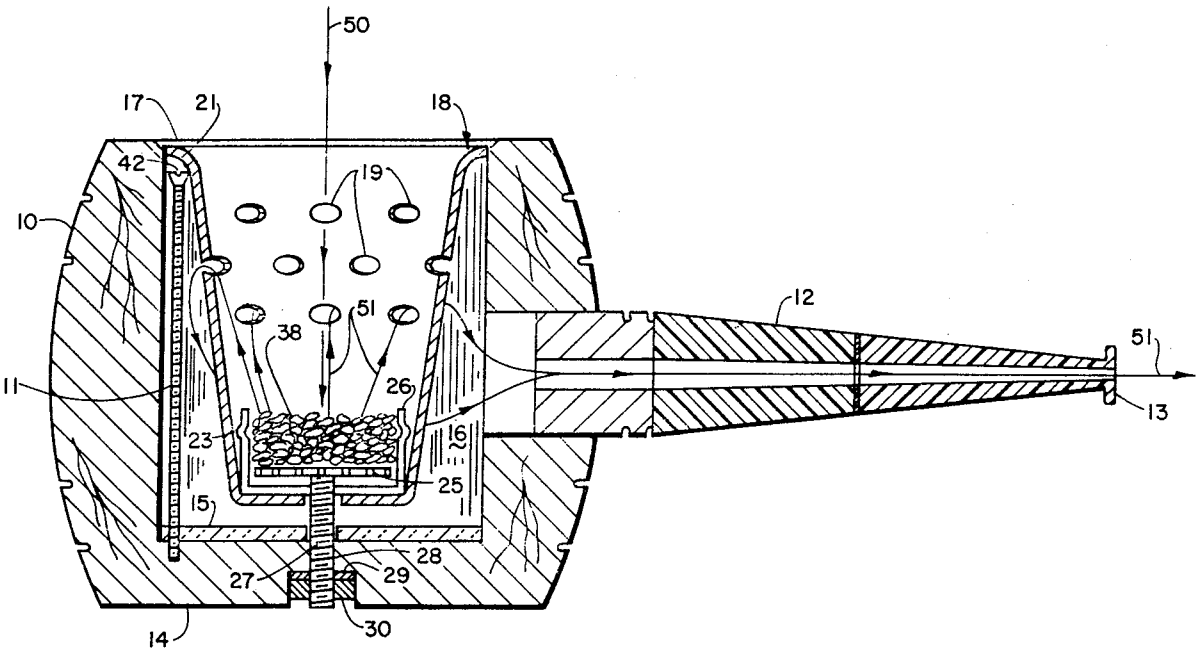
FIG. 3 is a cut away side elevational view of the assembled pipe of FIG. 1.

The bowl 10 has a bottom 14 which is relatively flat, as can best be seen in FIG. 3, and a heat insulating layer 15 can be provided, as shown, within the cavity 11 of the bowl 10, on the inside bottom surface. An inner or sub-bowl 18 is located within the outer bowl 10 as below described.

The sub-bowl 18 is made of metal or other electrically conducting material, and is received within the cavity 11 of the outer bowl 10. The top of the sub-bowl 18 has a flared top edge 21 which engages the tapered or shouldered top edge 17 of the outer bowl 10 to support the sub-bowl 18. The body of the inner bowl 18 is of smaller size than the interior 11 of the bowl 10, to create or define an air space or smoke receiving cavity 16 between the outside wall of sub-bowl 18 and the inside wall of the bowl 10. The bottom of the sub-bowl 18 additionally is located above the bottom 14 of the outer bowl 10 to further isolate the heat produced within the inner bowl 18 from the user.

The sub-bowl 18 also has one or more holes 19 adjacent its top above the level to which the tobacco would ordinarily be placed or packed. The holes 19 serve to provide smoke flow paths from the interior of the sub-bowl 18 to the smoke receiving chamber 16 between the sub-bowl 18 and the inner wall of the outer bowl 10.

The inner bowl 18 can be made of any convenient material, preferably metal such as chrome, brass or the like. (In the embodiment illustrated, the inner bowl 18 is a part of the electrical circuitry, and is therefore shown as being of metal.) Other suitable materials, however, can easily be employed with slight modification to the electrical portion of the pipe as is apparent to those skilled in the art.

A hole 24 is provided in the base of the inner bowl 18 to facilitate the mounting of a heater element 23, as below described.

The inside surface of the inner bowl 18 is polished to provide a heat reflective surface to aid in minimizing the heat transferred from the interior of the sub-bowl 18.

Desirably, the tobacco is not directly in contact with the reflective surface of the inner bowl 18, being emplaced within the contained heating element container, as below described. Thus, the reflective surface of the inner bowl 18 is not harmed or tarnished in use. At any rate, any tarnishing which does occur can easily be removed by regular cleaning and care.

A heating element 23 is located within the sub-bowl 18 adjacent its bottom. The heating element 23 can be of the type ordinarily used in an automobile cigarette lighter assembly, having a heating element 25 located within a cavity or bowl 26. The heating element 25 is connected at its center portion to a bolt 27 which extends downwardly from the heating element 23 to which electrical connection to one side of the heating element 25 can be made. The other side of the heating element 25 is connected to the metallic body or frame of the heating element 23, in a conventional manner. With the heating element 23 located in the bottom portion of the sub-bowl 18, and the sub-bowl 18 in turn located within the cavity 11 of the outer bowl 10, the bolt 27 extends through a hole 28 formed through the insulating layer 15 and the bottom 14 of the outer bowl 10. The heating element 23 and the sub-bowl 18 are then secured in place by a washer 29 and a nut 30 which engages the bolt 27. Because the entire body of the sub-bowl 18 except for the top flared portion 21 is spaced from the interior walls and bottom of the inside of the outer bowl, the heating element 23 is essentially "point suspended" so that the outer bowl will remain as cool as possible in use.

In one embodiment electrical connection is made to the heating element 23 via an electrical line 31 which includes two wires 33 and 34. The wires 33 and 34 are connected at one end to a plug, such a plug 35, which can, if desired, be of the type adapted to be inserted into an automobile cigarette lighter receptacle, as shown. The other ends of the wires 33 and 34 run through a grommet 36 through the wall of the outer bowl 10. The wire 34 of the line 31 is run through a hole 37 in the bottom 14 of the pipe bowl 10, and is welded or soldered to the washer 29 to establish electrical connection to the bolt 27 attached to one end of the heating element 25. The other wire 33 of the line 31 is connected first to a switch 40 mounted in the side of the bowl 10.

The other side of the switch 40 is connected by a wire 43 to an indicator light 41, also mounted in the wall of the outer bowl 10, and by a wire 44 to an elongated bolt or screw 42 which is located within the cavity 11 of the outer bowl 10 attached to the bottom 14. The elongated screw 42 makes physical contact with the flared edge 21 of the sub-bowl 18 when it is located within the cavity 11, to make electrical connection thereto, as shown particularly in FIG. 3. The other side of the indicator light 41 is connected by a wire 47 to the wire 34 to complete the electrical circuit to the indicator lamp 41 through the switch 40, such connection being made by a solder joint 48, or similar connection. Since the body of the heating element 23 is in physical contact with the electrically conducting sub-bowl 18, an electrical conduction path is also completed between the wire 33 and the other side of the heating element 25.

The electrical circuit established by the wires, above described, is illustrated in FIG. 2, in which the same reference numerals are used to identify the corresponding schematically depicted parts of the pipe of FIGS. 1 and 3. Thus, a connection is formed from the plug 35, through the switch 40 to the interior or sub-bowl 18. Additionally, a series connection is formed between the plug 35, the heating element 25, and the sub-bowl 18. The indicator lamp 41 is connected in parallel with the heating element 25 through the sub-bowl 18, as shown. Thus, when the switch 40 is closed, current will flow from the plug 35, through the switch 40, the indicator lamp 41, the sub-bowl 18, and the heating element 25, to complete the circuit back to the plug 35.

Figure 5:
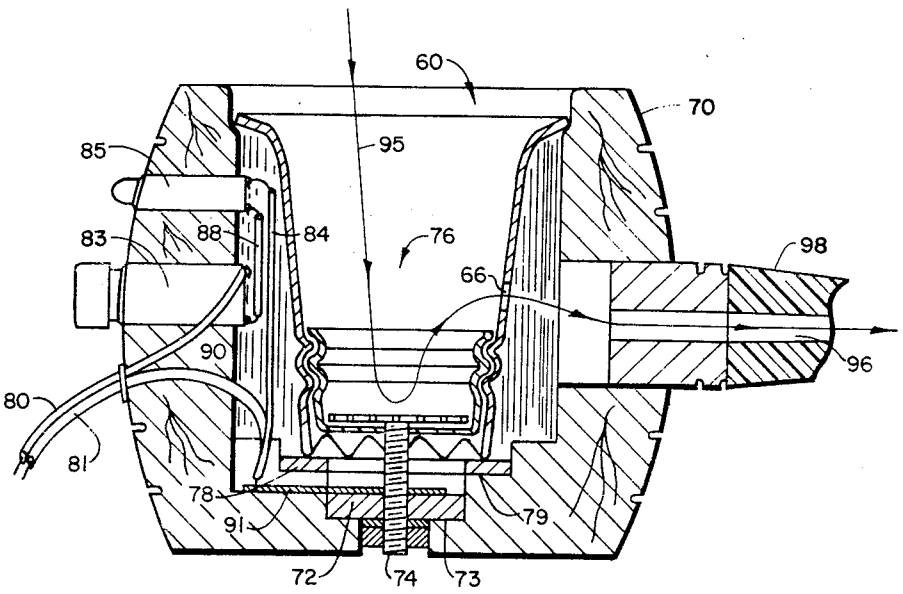
FIG. 5 is a cut away side elevation of an alternative embodiment of the pipe, in accordance with the invention, employing the inner bowl of FIG. 4.
Figure 4:
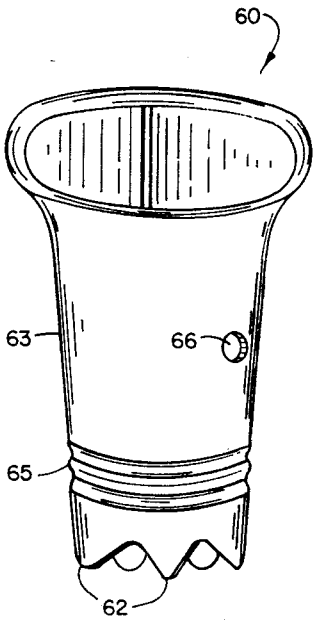
FIG. 4 is a perspective view of an inner bowl, in accordance with another embodiment of the pipe of the invention.

Another embodiment of an electrical connection system is shown with reference to FIGS. 4 and 5. This embodiment uses an electrically conducting inner bowl 60, shown in FIG. 4. The inner bowl 60 is made similarly to that described with reference to FIGS. 1 and 3, except that it is elongated to present a number of tabs or tongs 62 extending downwardly from its main body portion 63. The tabs 62 are of length sufficient to contact electrical connections at the bottom of the outside bowl when emplaced therein, as below described. A hole 66 extends through a wall of the inner bowl body 63 through which the smoke passes in use.

The inner bowl 60 also includes ridges 65 around its body near the tabs 62 which engage the heater element when it is located therein, also as shown in FIG. 5.

As shown in FIG. 5, an outer bowl 70 is provided which is similar to that above described with reference to FIGS. 1 and 3, except for the bottom electrical contacts next to be described. A first, relatively small, washer 72 is seated on a lower shoulder 73 in the base of the pipe 70. The washer 72 provides the electrical contact to the center post 74 of the heater assembly 76. A second, larger, washer 78 is coaxially located above the first washer 72 on a higher shoulder 79.

Thus, with the inner bowl 60 assembled within the outer bowl 70, the lower tabs 62 rest upon and make electrical contact with the upper larger washer 78. The heating element 76, engaged by the ribs or grooves 65 of the inner bowl 60, has its screw post 74 extending downward to establish electrical connection to the lower washer 72.

The electrical wiring to the various elements of the pipe is made by wires 80 and 81. The wire 81 contacts the upper washer 78, and the wire 80 contacts one side of a switch element 83. A wire 84 interconnects the washer 78 and one side of an indicator lamp 85, and a wire 88 interconnects the other side of the indicator lamp 85 and the switch 83. This other side of the switch 83 is connected to the lower washer by a wire 90 connected to a bus 91, which, in turn, contacts the lower washer 72.

The schematic diagram of FIG. 2 also represents (except for the reference numerals) the electrical connections of the embodiment of FIG. 5. That is, the potential source (not shown) is connected across the heating element on one side by the wire 80, the switch 83, the lower washer 72, and the screw shaft 74, and on the other side by the wire 81, the upper washer 78, the inner bowl 60 and the wall of the heating element 76. The indicator lamp is connected in parallel with the heating element by connection to the switch 83 and the upper washer 78.

With a pipe constructed with reference again to FIGS. 1–3, as above describe, a small amount of tobacco can be placed within the sub-bowl 18, and preferably within the container 26 of the heating element 25. The only air path to the ignition point of the tobacco being directly from above, as shown by the arrowed line 50, little air exists within the container 26 deep within the pipe 10. Consequently, the tobacco does not burn in the usual manner, but instead emits an extremely dense smoke. The switch 40 is then depressed, with the plug 35 connected to an appropriate potential source, and the heating element heats, igniting the tobacco from the bottom portion of the sub-bowl 18. As a vacuum is applied by the smoker upon the stem 12, the smoke generated will travel, as shown by the arrowed line 51, through the unburned tobacco above the heating element assembly 23, through the holes 19 to the area 16 between the sub-bowl 18 and the outer bowl 10, to be withdrawn through the channel 13 of the stem 12.

The smoke path of the embodiment of FIG. 5 is the same as that above described with respect to FIGS. 1 and 3. As shown by the arrowed line 95, the air enters the top of the pipe to the combustion area within the heating element 76. It then travels through the outlet hole 66 through the channel 96 in the stem 98.

Because the smoke produced is so dense, if desired the pipe can be provided with an auxiliary air vent, such as the tube 45, extending outwardly from a wall of the pipe bowl 10, as shown in FIG. 1. The tube 45 has a channel 46 therethrough communicating to the interior cavity 11 of the bowl 10. The tube 45 is adapted to be covered at its end by the user's finger to block the channel 46, or open it, as desired, to permit fresh air to be drawn into the smoke receiving cavity 16 between the inside of the bowl 10 and the outside of the sub-bowl 18, to cut the smoke. This may be especially desired in uses in which the particular tobacco used is particularly moist or otherwise itself emits dense concentrated smoke which would be objectionable to smoke or inhale. The tube 45, can, of course, be omitted entirely, if desired.

Although the invention has been described and illustrated with a certain degree of particularity, it is understood that the present disclosure has been made only by way of example and that numerous changes in the details of construction and the combination and arrangement of parts may be resorted to without departing from the spirit and scope of the invention as hereinafter claimed.

I claim:

1. A pipe comprising:

a first bowl, a stem outwardly extending from a wall of said first bowl, having a longitudinal channel therewithin communicating with the interior of said bowl, a second bowl of electrically conducting material within said first bowl adapted to receive tobacco therewithin and having a reflective interior surface to reduce the heat conducted through said second bowl, the top of said second bowl being in engagement with the top of said first bowl, and second second bowl being of smaller size than said first bowl to define a smoke receiving cavity between said first and second bowls, said second bowl having at least one hole adjacent its top to permit smoke within said second bowl to pass from the tobacco into the smoke receiving cavity and said longitudinal stem channel when a vacuum is drawn on said stem channel, an electrical heating element for igniting the tobacco in said second bowl, said heating element having an electrical contact thereto contacting said second bowl, a bolt connected to another electrical contact of said heating element, and, a source of electrical potential connected between said bolt and said second bowl for energizing said element to ignite the tobacco.

2. The pipe of claim 1 further comprising a tube extending outwardly from said first bowl having a longitudinal channel therethrough communicating with said smoke receiving cavity to conduct air thereto upon application of a vacuum to the channel of said stem, the opening of said channel in said tube being closeable by applying a finger thereover to control the air flow into said smoke receiving cavity.

3. A pipe comprising:

a bowl, a metal sub-bowl within said bowl, having a tobacco receiving portion adjacent a bottom portion thereof, having a top portion in engagement with a top portion of said bowl, being of smaller size than said bowl to define an air space separating said bowl and said sub-bowl within said bowl, and having at least one hole adjacent a top portion and above a tobacco receiving portion to provide a smoke flow path from within said sub-bowl to within said air space between said bowl and said sub-bowl, stem means extending outwardly from a side of said bowl, having a channel therewithin communicating with said air space, a heating element carried within the tobacco receiving portion of said sub-bowl, a switch mounted on said bowl, an indicator lamp mounted on said bowl, means connecting said heating element, said switch and said indicator lamp electrically in series, a source of electrical potential connected across said series connection whereby when said switch is closed, the indicator lamp lights and heating element heats to ignite the tobacco.

4. The pipe of claim 3 wherein said sub-bowl comprises a polished interior surface to reflect heat therewithin.

5. The pipe of claim 4 wherein said sub-bowl is of brass.

6. The pipe of claim 4 wherein said sub-bowl is of bronze.

7. The pipe of claim 4 wherein said sub-bowl is copper.

8. The pipe of claim 4 wherein said sub-bowl is chrome.

* * * * *